US007769336B2

(12) United States Patent
Ishizuka

(10) Patent No.: US 7,769,336 B2
(45) Date of Patent: Aug. 3, 2010

(54) IMAGE FORMING APPARATUS

(75) Inventor: Jiro Ishizuka, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 12/140,019

(22) Filed: Jun. 16, 2008

(65) Prior Publication Data

US 2009/0003879 A1 Jan. 1, 2009

(30) Foreign Application Priority Data

Jun. 18, 2007 (JP) ..... 2007-160216

(51) Int. Cl.
*G03G 15/20* (2006.01)
*G03G 15/16* (2006.01)
*H05B 11/00* (2006.01)

(52) U.S. Cl. ..... 399/341; 399/122; 399/320; 399/330; 219/216

(58) Field of Classification Search ..... 399/122, 399/320, 330, 341; 219/216
See application file for complete search history.

(56) References Cited

U.S. PATENT DOCUMENTS 5,572,291 A * 11/1996 Moriguchi et al. ..... 399/390
2006/0251451 A1* 11/2006 Ishigami et al. ..... 399/328
2007/0134013 A1* 6/2007 Soya et al. ..... 399/49

FOREIGN PATENT DOCUMENTS

JP 2004-109860 A 4/2004
JP 2004-205563 A 7/2004
JP 2007-47306 A 2/2007

* cited by examiner

*Primary Examiner*—David P Porta
*Assistant Examiner*—Mindy Vu
(74) *Attorney, Agent, or Firm*—Canon USA Inc IP Division

(57) ABSTRACT

A fixing step before smoothing by a smoothing device causes the phenomenon that a photo-medium is not properly separated from a fixing device due to a toner receiving layer of the photo-medium. Therefore, in order to prevent the occurrence of defective separation in the fixing device, a predetermined image pattern is formed using a toner containing a wax component in a margin, i.e., a non-image forming region, at the leading end of the photo-medium.

6 Claims, 12 Drawing Sheets

BEFORE FIXING

AFTER FIXING

IMAGE FORMING APPARATUS

BACKGROUND OF THE INVENTION

1. Field of the Invention

The present invention relates to an image forming system for forming an image on a recording material. Specifically, the present invention relates to an image forming system for obtaining an output with a smooth surface using a recording material having a surface provided with a toner receiving layer composed of a thermoplastic resin.

The image forming system can be used for, for example, a copying machine, a printer, and FAX, which form images by an electrophotographic system, and a compound machine having the functions of these apparatuses.

2. Description of the Related Art

Many image forming apparatuses for forming full-color images have been commercialized and requirements for image quality have been increasingly advanced with use in various fields.

In particular, in order to improve the quality of full-color images, it is required to improve image glossiness. One of factors which determine the glossiness of images is the smoothness of output images.

For such a requirement, Japanese Patent Laid-Open Nos. 2004-205563 and 2006-250979 have proposed an image forming apparatus for forming a color image using a recording material provided with a transparent resin layer (toner receiving layer) composed of a thermoplastic resin. In this image forming apparatus, a toner image is fixed to the transparent resin layer using a first fixing device not provided with a cooling device and then smoothed by a second fixing device provided with a cooling device.

Specifically, in the first fixing device, heating and pressing are performed in a degree which allows the toner to be temporarily fixed to the transparent resin layer. This is aimed at preventing offset of the toner to another conveying mechanism in a process of conveying a recording material to the second fixing device.

On the other hand, in the second fixing device, the recording material on which the toner image has been fixed is pressed and heated with a high-gloss belt and then cooled while being adhered to the belt. After the recording material is sufficiently cooled, the recording material is separated from the belt.

As a result, the toner image is buried in the transparent resin layer of the recording material, and the transparent resin layer is smoothed by the surface of the belt, thereby forming a color image with excellent glossiness. Therefore, such an image forming technique attracts attention because it can produce an output with high glossiness equivalent to a silver-salt photograph in spite of being an electrophotographic image forming apparatus.

However, the configurations disclosed in Japanese Patent Laid-Open Nos. 2004-205563 and 2006-250979 may cause the problem described below.

Specifically, in spite of heating and pressing treatment in a degree which allows the toner to be temporarily fixed to the transparent resin layer, there may be caused the phenomenon that the recording material cannot be properly separated from the first fixing device due to the transparent resin layer on the surface of the recording material.

This is possibly due to the fact that the transparent resin layer functions as an adhesive because the leading region of the recording material in the conveyance direction is a region (so-called margin) in which the toner image is not formed, and the recording material at a high temperature is separated from the first fixing device.

In particular, the problem is significant when a resin not containing a wax component is used in the transparent resin layer of the recording material in view of compatibility with the toner. This is because the releasing effect of the wax component cannot be expected.

When the thickness of the recording material is increased for preventing defective separation, a large quantity of energy is required for the heating and cooling steps. Therefore, this method is not a measure for resolving the problem.

SUMMARY OF THE INVENTION

The present invention provides an image forming apparatus including an image forming unit for forming an image on a recording material having a surface which is provided with a toner receiving layer composed of a thermoplastic resin using a toner containing a wax component, a fixing unit for heat-fixing the image formed on the recording material by the image forming unit in a nip portion and separating the recording material kept at a high temperature, a smoothing unit for smoothing the surface of the recording material by heating, cooling, and then separating the recording material on which the image has been fixed by the fixing unit, and an image pattern forming unit for forming a predetermined image pattern in a non-image forming region at the leading end of the recording material in the conveyance direction.

Further features of the present invention will become apparent from the following description of exemplary embodiments (with reference to the attached drawings).

DESCRIPTION OF THE EMBODIMENTS

The present invention will be described in detail below with reference to embodiments. These embodiments are examples of preferred embodiments of the present invention, but the present invention is not limited to the embodiments.

First Embodiment

Figure 2:
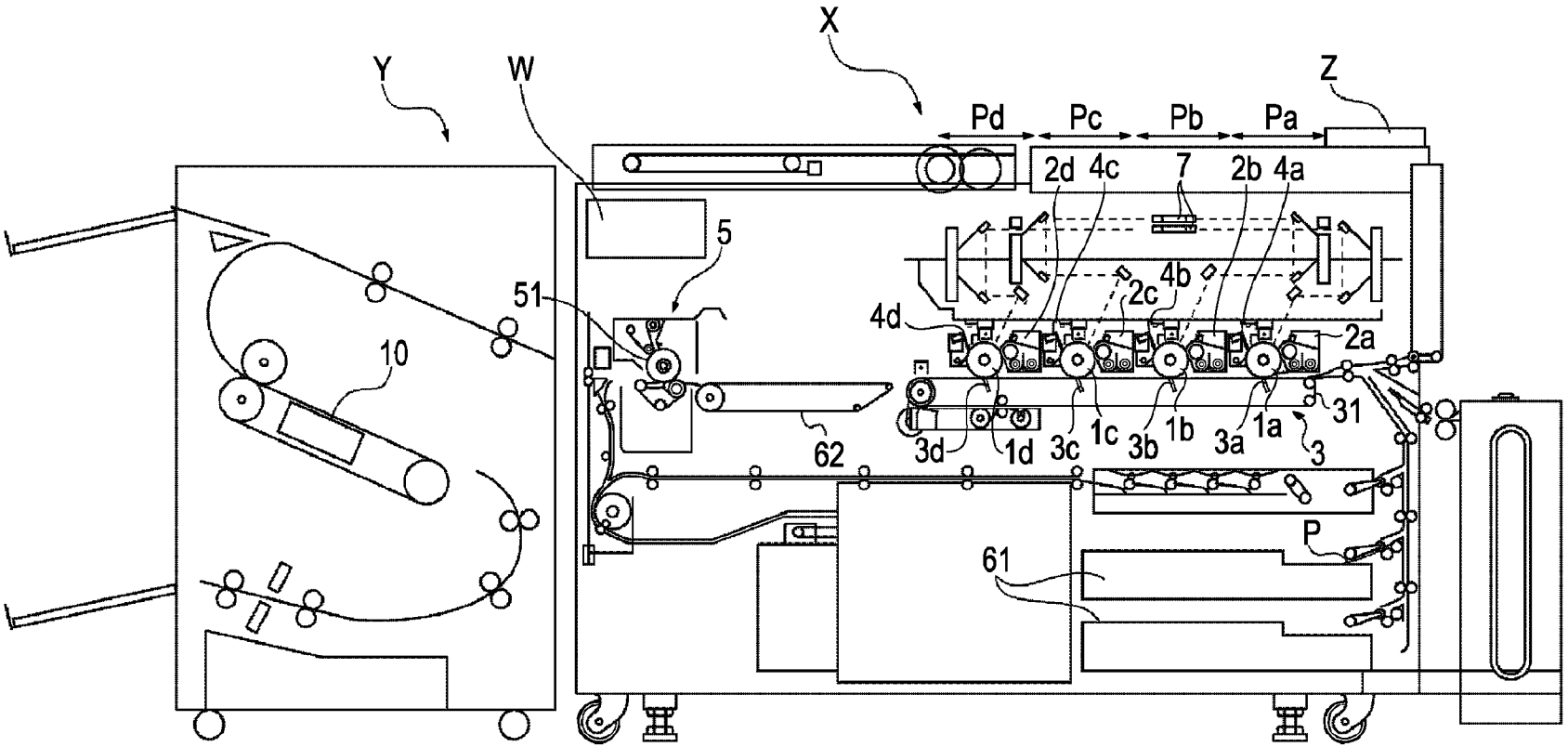
FIG. 2 is a schematic drawing of an image forming system including a fixing device and a smoothing device.
Figure 6:
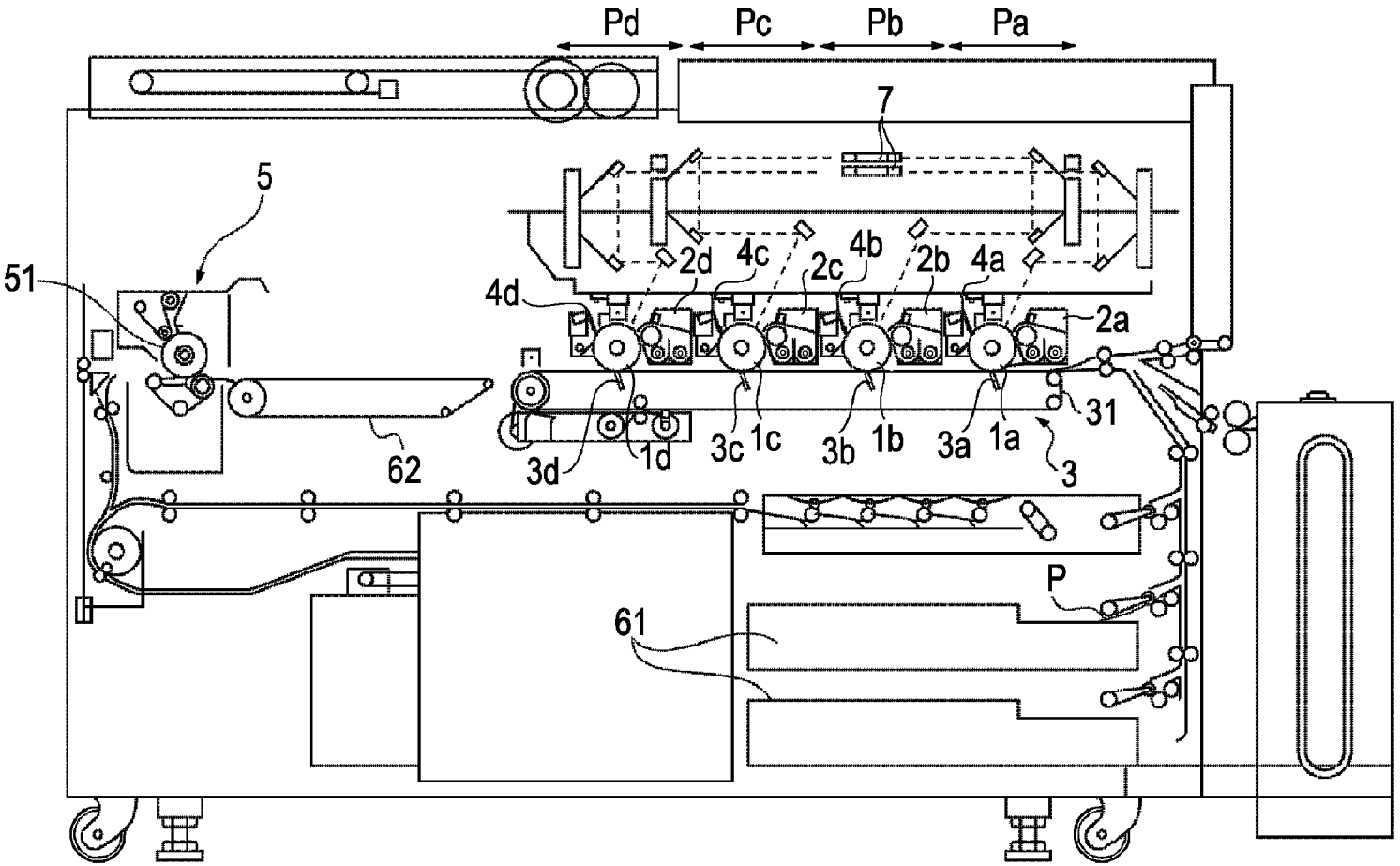
FIG. 6 is a schematic drawing of an image forming apparatus to which a smoothing device is not connected.

An example of an image forming system provided with a full-color copying machine is described with reference to the drawings. In this example, as shown in FIG. 2, an image forming system includes an image forming apparatus X and a glossing unit Y. The image forming apparatus X is configured to function independently as a copying machine as shown in FIG. 6. The glossing unit Y is an optional apparatus which can be attached and/or detached according to user's demand. In other words, the glossing unit Y is detachable from the image forming apparatus X. As another example of an image forming system, another image forming apparatus may be used, in which the image forming apparatus X and the glossing unit Y cannot be separated from each other, and the two functions of the image forming apparatus X and the glossing unit Y are integrated.

(Image Forming Portion)

Figure 3:
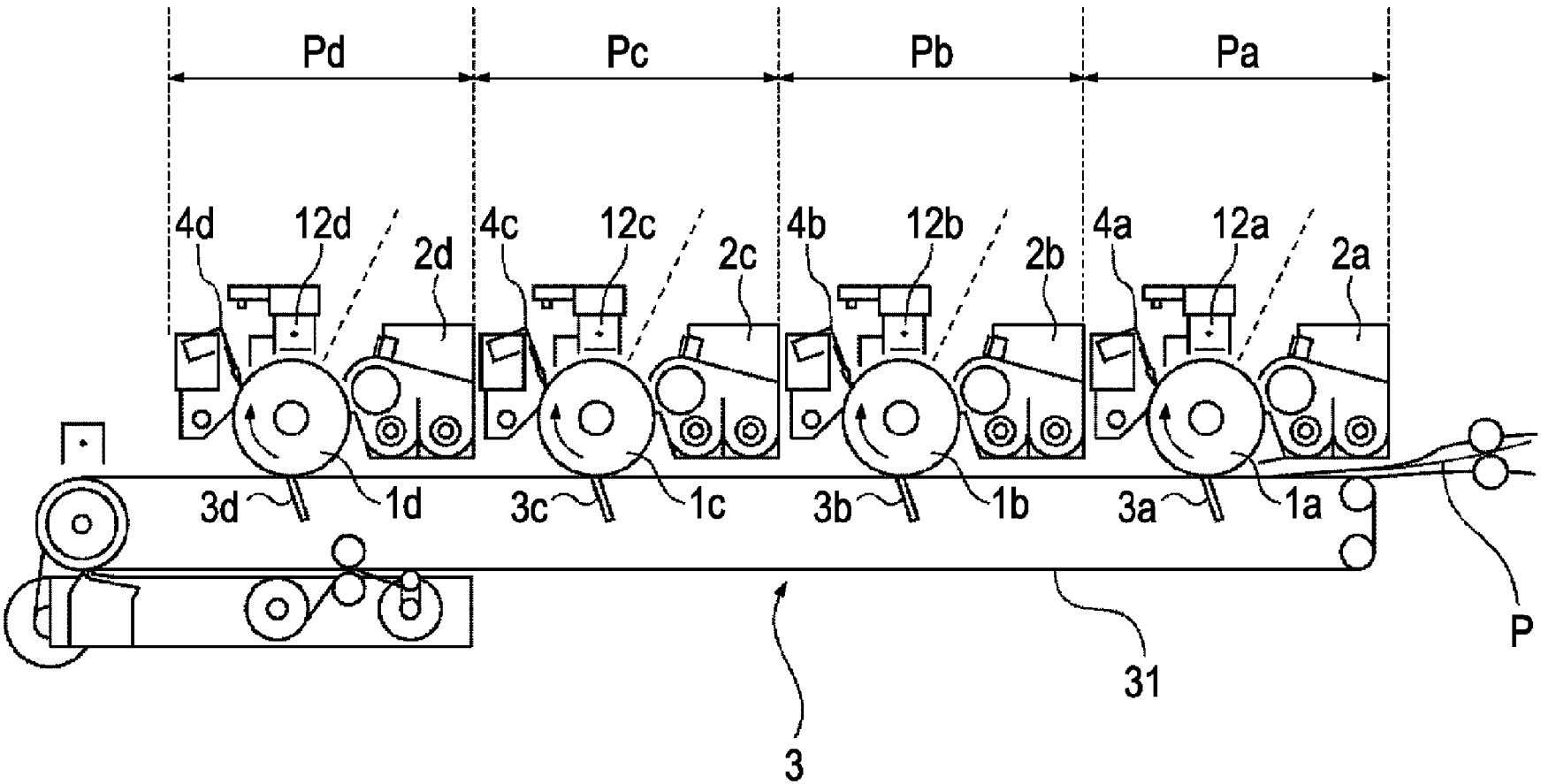
FIG. 3 is an enlarged view of an image forming portion.

First, an image forming portion is described with reference to FIGS. 2 and 3. The configuration shown in FIG. 6 is substantially the same as in FIG. 2, and thus a description thereof is omitted.

As shown in FIG. 2, a reader portion for reading a copy document by photoelectric transducers such as CCD is provided in an upper portion of an image forming apparatus, and image forming stations $P_a$ to $P_d$ are disposed as an image forming unit below the reader portion. The image forming stations $P_a$ to $P_d$ are arranged for different color toners, such as magenta toner, cyan toner, yellow toner, and black toner, along the conveyance direction of a recording material. Further, a transfer unit 3 (portion of the image forming unit) for conveying the recording material is provided below the image forming stations $P_a$ to $P_d$.

Next, the configuration of each of the image forming stations $P_a$ to $P_d$ is described in detail with reference to FIG. 3. Since the image forming stations $P_a$ to $P_d$ have the same configuration, the image forming station $P_a$ is described as an example, and description of the other image forming stations $P_b$ to $P_d$ is omitted.

The image forming station $P_a$ is provided with an electrophotographic photosensitive member (hereinafter referred to as a "photosensitive drum") 1*a* as an image bearing member which is rotatable in an arrow direction. Further, a charger 12*a* serving as a charging device, a laser irradiation portion serving as an exposure device 7, a development device 2*a*, and a cleaner 4*a* are disposed around the photosensitive drum 1*a* along the rotational direction thereof. In addition, a transfer blade 3*a* serving as a transfer device is provided below the photosensitive drum 1*a*.

In an image forming process, first the surface of the photosensitive drum 1*a* is uniformly negatively charged by the charger 12*a*, and then an image is exposed by the exposure device 7 on the basis of the document image information read by the reader portion. In the image exposure, an electrostatic latent image formed on the photosensitive drum 1*a* is developed with toner in the development device 2*a*. Then, when a transfer bias (positive polarity) is applied to the transfer blade 3*a*, the toner image on the photosensitive drum 1*a* is electrostatically transferred to a recording material P which is conveyed by a transfer belt 31 serving as a recording material bearing member (portion of the image forming device). After the transfer, the toner remaining on the photosensitive drum 1*a* is removed and recovered by the cleaner 4*a* so that the photosensitive drum 1*a* is subjected to the formation of next image.

The toner images formed in the respective image forming stations $P_a$ to $P_d$ are sequentially superposed and transferred on the recording material P held by the transfer belt 31 to form a full-color image.

The recording material P is conveyed by the transfer belt 31 as follows: The recording material P held in a cassette 61 serving as a recording material supply unit is separated from other recording materials by a pickup roller and then conveyed to the position of a resist roller pair by a conveying roller pair. The resist roller pair conveys the recording material to the transfer belt 31 with predetermined timing which coincides with toner image transfer timing from the photosensitive drum 1*a*. Consequently, the recording material is held at an appropriate position of the transfer belt 31.

After the transfer step is completed, the recording material P is separated from the transfer belt 31 and then conveyed to a fixing device 5 by a conveying belt 62 serving as a recording material guide unit.

In this example, a polyester resin containing 5 parts by weight (% by weight) of a wax component is used. The toner has a glass transition temperature of 55° C.

The image forming portion is capable of forming a monochrome image using black toner and an image using the above-described four color toners.

(Fixing Device)

Figure 4:
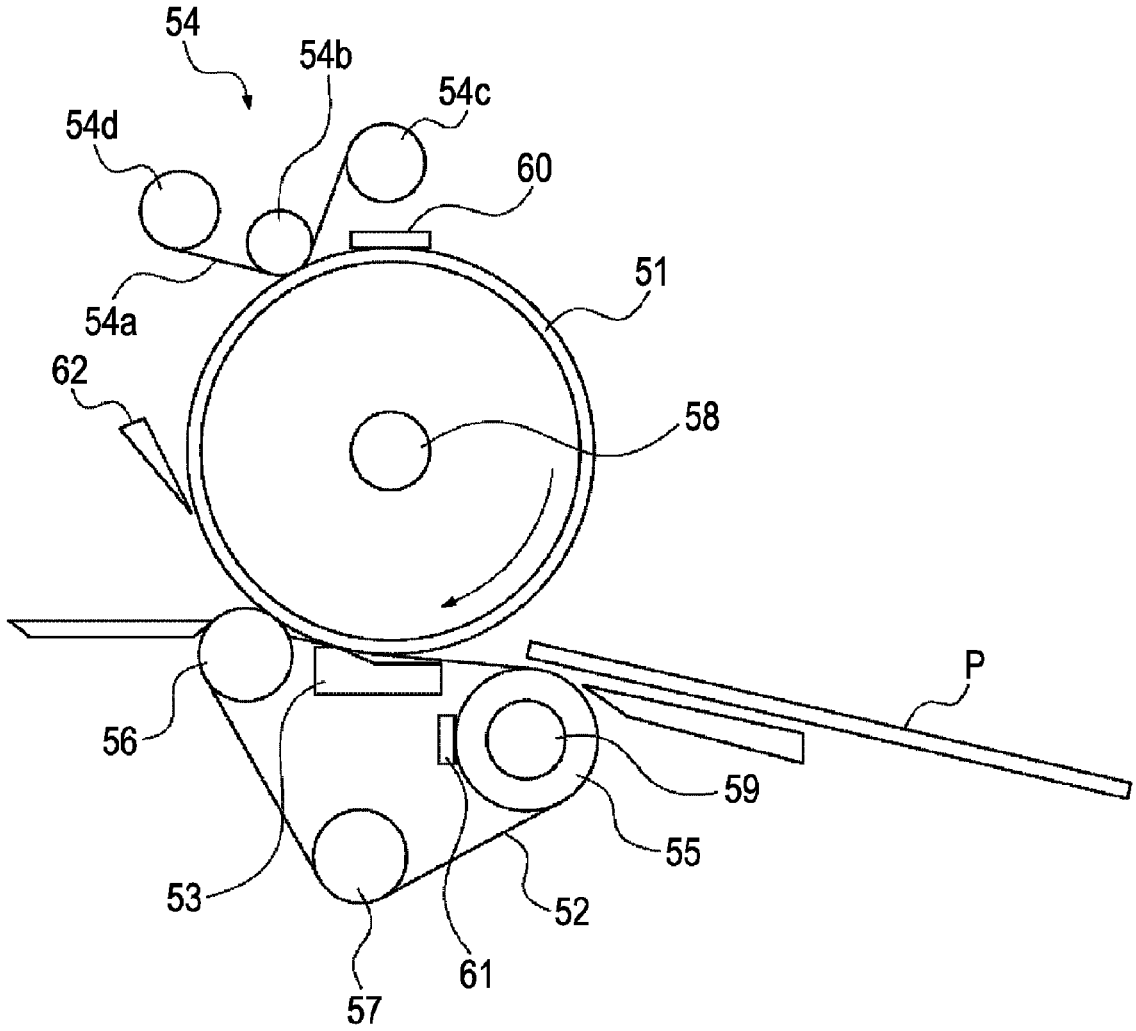
FIG. 4 is an enlarged view of a fixing device.

Next, the fixing device 5 is described with reference to FIG. 4. The fixing device 5 is a high-temperature separation type in which an unfixed image formed on the recording material is heat-fixed in the nip portion (fixing nip described below) as described below.

The fixing device 5 includes a fixing roller 51 serving as a fixing rotary member, and a pressing belt 52 serving as a pressing rotary member which is stretched on a plurality of rollers 55, 56, and 57 and which is rotated in pressure contact with the fixing roller 51.

The fixing roller 51 includes a core metal composed of Al, Fe, or the like, an elastic layer provided thereon, and a surface layer provided on the surface of the elastic layer and composed of a fluorocarbon resin or the like.

The pressing belt 52 includes a base material composed of a resin such as polyimide or a metal such as nickel, and a surface layer provided on the surface of the base material and composed of a fluorocarbon resin. In addition, an elastic layer may be provided between the base material and the surface layer. The roller 56 is made of a metal and has the function as a separation roller. Namely, the recording material P is pressed through the pressing belt 52 so as to cut into the fixing roller 51 to deform the elastic material of the fixing roller 51, thereby separating the recording material P from the surface of the fixing roller 51.

Further, a pressing pad 53 is provided inside the pressing belt 52 so as to function to press the pressing belt 52 toward the fixing roller 51. The pressing pad 53 includes a rubber elastic layer and a low-sliding sheet which covers the elastic layer.

Therefore, the pressing pad 53 and the separation roller 56 form the fixing nip which is sufficiently long in the conveyance direction of the recording material P between the fixing roller 51 and the pressing belt 52.

Further, a cleaning device 54 is attached to the fixing roller 51 so that foreign materials, such as toner, offset onto the fixing roller 51 are cleaned off by the cleaning device 54. The cleaning device 54 includes a web 54*a* and a pressure roller

54*b* for pressing the web 54*a* on the fixing roller 51. Further, an unwinding roller 54*c* and a winding roller 54*d* are provided for moving the web 54*a* so that a new surface of the web 54*a* is put into contact with the fixing roller 51.

The cleaning device 54 is provided upstream of a thermistor 60 in the rotational direction of the fixing roller 51 so as not to cause a defect in temperature detection due to the adhesion of offset toner to the thermistor 60.

The web 54*a* is wound by a method in which a solenoid is turned on to operate a one-way clutch at each time of copy of a predetermined number of sheets and wind the web 54*a* in a predetermined amount in a direction opposite to the rotational direction of the fixing roller 51 in the cleaning portion. The web 54*a* is impregnated with a releasing agent such as silicone oil or the like in order to suppress offset of toner to the fixing roller 51 by the releasing agent.

Further, halogen heaters 58 and 59 are disposed as heating devices in the fixing roller 51 and the roller 55, respectively. In addition, the thermistors 60 and 61 are disposed as temperature detectors in contact with the fixing roller 51 and the roller 55, respectively. A control circuit provided in a control device W controls power supplies to the heaters 58 and 59 on the basis of the temperature information detected by the thermistors 60 and 61, respectively. The control circuit controls the power supplies to the heaters 58 and 59 so as to maintain target temperatures determined for the fixing roller 51 and the roller 55, respectively. In this example, the target temperatures of the fixing roller 51 and the roller 55 are 170° C. and 120° C., respectively. After the start of fixing, the supply of electricity to the heater 59 is stopped.

In the state in which fixing can be performed, when the recording material P is conveyed, the rotation of the fixing roller 51 and the pressing belt 52 is started, and the recording material P is pressed and heated when passing through the fixing nip to fix an unfixed toner image to the recording material P. Then, the recording material P is separated from the fixing device 5 while maintaining a high temperature without being cooled by a cooling device or the like. In this example, the separation temperature of the recording material P in the fixing device 5 is about 170° C. which is substantially the same as that of the fixing roller 51. At this time, the recording material P is easily separated from the fixing roller 51 using a separation claw 62.

In this example, the fixing device 5 has a plurality of fixing rates according to types of recording materials. Specifically, the fixing rate of a recording material (normal paper) having a basis weight of 80 g/m$^2$ is set at 200 mm/sec, and the fixing rate of a recording material (thick paper) having a basis weight larger than this is set at 120 mm/sec.

Figure 7A:
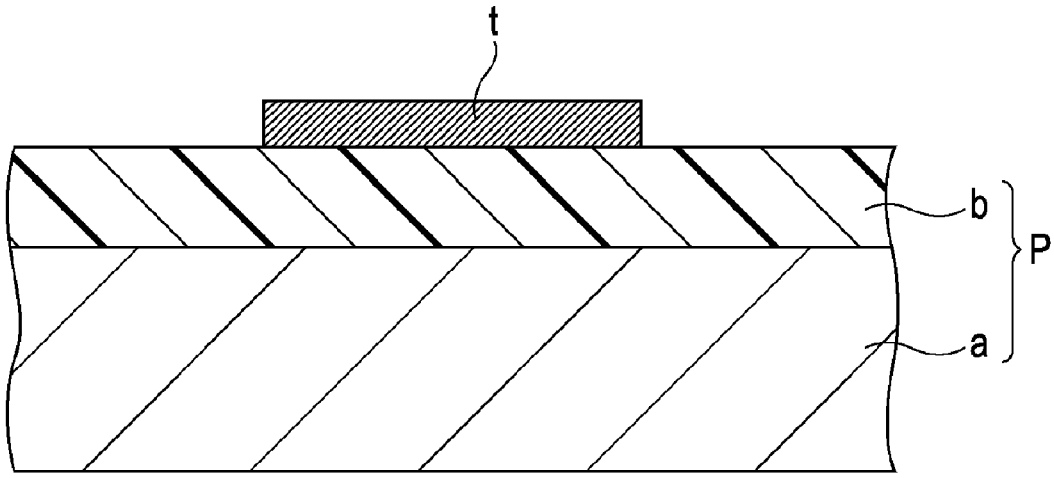
FIG. 7A is a schematic drawing showing a state before fixing of an unfixed toner image on a photo-medium.

As a result of fixing, an unfixed toner image t is temporarily fixed on the toner receiving layer b of a photo-medium as the recording material P which will be described below, as shown in FIG. 7A.

(Smoothing Device)

Next, a smoothing device 10 provided in the glossing unit Y is described with reference to FIG. 5. The smoothing device 10 functions to smooth the surface of the recording material P by heating, cooling, and then separating the recording material on which an image has been fixed by the fixing device 5. Namely, the smoothing device 10 of this example is a low-temperature separation type.

Figure 7B:
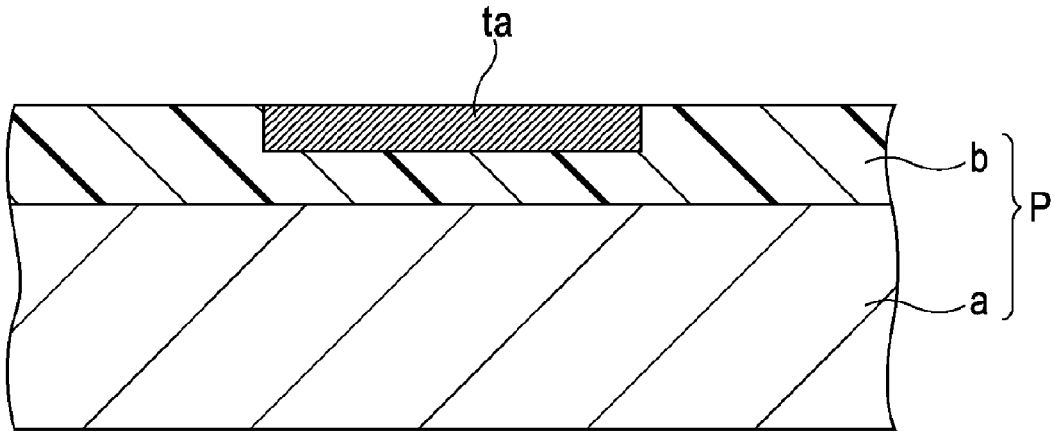
FIG. 7B is a schematic drawing showing a state in which a toner image is buried in a toner receiving layer of a photo-medium by smoothing.

Specifically, the smoothing device 10 functions to change the toner receiving layer which is an image surface of the photo-medium described below from a state shown in FIG. 7A to a state shown in FIG. 7B. In other words, the toner image (a fixed toner image ta) is buried in the toner receiving layer b to create a state in which the whole surface of the toner receiving layer is smoothed. Namely, the smoothing device 10 functions to form an image with glossiness equivalent to a silver salt photograph.

The smoothing device 10 of this example includes a belt 107 as a high-gloss endless belt (smoothing belt) which is rotatably put on a heating roller 101 as a heating rotor and a separation roller 103. Further, the smoothing device 10 includes a pressing roller 102 as a pressing rotary member provided to held the belt 107 between the heating roller 101 and the pressing roller 102 in order to form a heating nip between the belt 107 and the pressing roller 102. In addition, the smoothing device 10 includes a cooling device 106 provided inside the belt 107, for cooling the belt 107 in a recording material conveyance region between the heating roller 101 and the separation roller 103.

The heating roller 101, the pressing roller 102, and the separation roller 103 are disposed in substantially parallel to each other.

The belt 107 is an endless belt composed of a siloxane-modified polyimide single layer. The surface (in contact with the recording material P) of the belt 107 has surface property (mirror-like) having high glossiness for smoothing the image surface of the photo-medium as the recording material P as described below.

The heating roller 101 has a concentric three-layer structure including a core portion and an elastic layer and a release layer which are laminated in order on the core portion. The core portion is composed of an aluminum hollow pipe having a diameter of 44 mm and a thickness of 5 mm. The elastic layer is composed of a silicon rubber having a JIS-A hardness of 50 and a thickness of 300 μm. The release layer is composed of a fluorocarbon resin (in this example, a PFA resin) having a thickness of 50 μm. Further, a halogen lamp 108 as a heating device is installed in the heating roller 101 (in the hollow pipe of the core portion), and a thermistor 140 as a temperature detector is installed in contact with the surface of the heating roller 101.

The heating roller 101 is rotated at a predetermined speed in the clockwise direction by a driving mechanism (not shown). The heating roller 101 is driven and rotated in the clockwise direction by rotation of the heating roller 101. The separation roller 103 and the pressing roller 102 are driven and rotated by rotation of the belt 107.

The pressing roller 102 has the same configuration as the heating roller 101. However, the elastic layer is composed of a silicon rubber having a thickness of 3 mm. This is because the thickness of the elastic layer is increased to gain the width (in the conveyance direction of the recording material) of the heating nip. Further, a halogen lamp 109 as a heating device is installed in the pressing roller 102 (in the hollow pipe of the core portion), and a thermistor 141 as a temperature detector is installed in contact with the surface of the pressing roller 102.

The pressing roller 102 is pressed into contact with the heating roller 101 under predetermined pressure in order to form the heating nip between the belt 107 and the pressing roller 102. In this example, the total pressure on the pressing roller 102 is 490 N (50 kgf). The width of the heating nip (in the conveyance direction of the recording material) is 5 mm.

Figure 5:
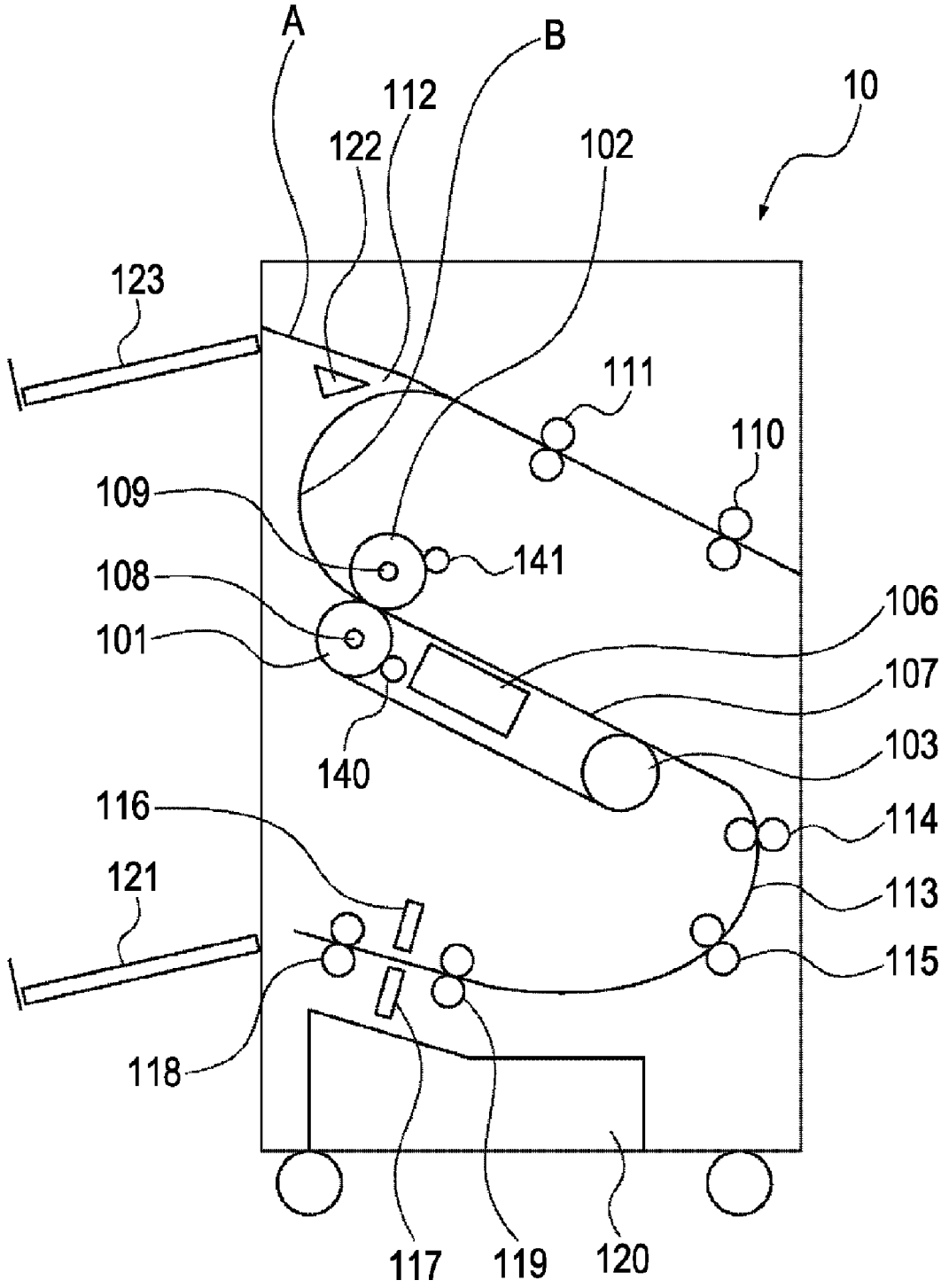
FIG. 5 is an enlarged view of a smoothing device.

The cooling device 106 is provided with a cooling fan and a duct which is opened on the side near the belt (the upper side in FIG. 5). The cooling fan produces an air flow in the duct in a direction perpendicular to the drawing of FIG. 5 so that the region of the belt 107 facing the duct is forced to cool with high efficiency. As a result, the recording material P is cooled to a temperature near the glass transition temperature (in this example, 55° C.) of the toner. Therefore, when the recording material P is separated from the belt 107, offset of the toner and a portion of the toner receiving layer, which will be described below, to the belt 107 is prevented. As the cooling device 106, a contact-type cooling device such as a Peltier element, a heat pipe, or the like, or a water circulation-type cooling device may be used in stead of the fan.

Further, the control device W (FIG. 2) for controlling the surface temperatures of the heating roller 101 and the pressing roller 102 is provided with a control circuit. The control circuit controls the power supplies to the halogen heaters 108 and 109 which are built in the heating roller 101 and the pressing roller 102, respectively, on the basis of the temperature information of the heating roller 101 and the pressing roller 102 detected by the thermistors 140 and 101, respectively. In this case, the control circuit controls the power supplies to the halogen heaters 108 and 109 on the basis of the target temperatures determined for the heating roller 101 and the pressing roller 102, respectively. In this example, both the target temperatures of the heating roller 101 and the pressing roller 102 are determined to 160° C.

Next, the smoothing process is described.

The recording material P ejected from the fixing device 5 passes through conveyance roller pairs 110 and 111 and reaches the smoothing device 10 through an inversion guide 112. Then, the recording material P is introduced into the heating nip between the belt 107 and the pressing roller 102 and heated and pressed. In this treatment, the toner receiving layer of the recording material P, which will be described below, is softened by heating together with the toner, and the toner is buried in the toner receiving layer by pressing, thereby bringing the toner receiving layer in tight contact with the surface of the belt 107.

Then, the recording material P passes through the cooling region with the cooling device 106 while being in tight contact with the belt 107 and is conveyed to a separation region which will be described below. During this time, the recording material P is cooled to about 55° C. in the cooling region in order to prevent offset of the toner and the toner receiving layer to the belt 107. In addition, the recording material P is separated (curvature separation) from the surface of the belt 107 by virtue of its rigidity in the separation region of the belt 107 put on the separation roller 103.

In a series of these operations, the smooth surface of the belt 107 is transferred to the surface (toner receiving layer) of the recording material P to obtain a high-gloss image.

The smoothed recording material P is again inverted by an inversion guide 113 and conveyed to a cutting device 116 by conveyance roller pairs 114 and 115.

The cutting device 116 includes a guillotine cutter 117 for cutting the recording material P by movement in a direction perpendicular to the conveyance direction of the recording material P and a rotary cutter 118 for cutting along the conveyance direction of the recording material P so that the recording material P is cut into a desired size.

The recording material P conveyed to the cutting device 116 is conveyed to pre-cutter register detection rollers 119 by conveyance rollers 118. The position of the recording material P is recognized by the pre-cutter register detector rollers 119, and the operation of the guillotine cutter 117 is started according to the detected information. The guillotine cutter 117 includes a one-tooth cutter which is longer than the maximum usable length of the recording material P and which is disposed perpendicularly to the conveyance direction of the recording material P. The cutter is moved downward from above the recording material to cut the recording material perpendicularly to the conveyance direction. Next, the recording material P is conveyed to the rotary cutter 118 and automatically cut in the conveyance direction. In this case, the position of the rotary cutter 118 is moved according to a desired cutting width so that the recording material P can be cut into various sizes. Unnecessary portions of the recording material P after cutting are recovered to a recovery device 120. Then, the recording material P subjected to desired cutting is ejected to a paper eject tray 121.

(Photo-Medium)

The photo-medium as the recording paper which is dedicated paper prepared for smoothing in the smoothing device 10 is described with reference to FIG. 7. As shown in FIG. 7, the photo-medium has a structure in which a toner receiving layer b composed of a thermoplastic resin is laminated over the entire surface of a base material a. The toner receiving layer b is positioned at the outermost surface of the photo-medium so as to be used as an image forming surface. In this example, the thermoplastic resin which becomes transparent by heating is used for the toner receiving layer.

The largest characteristic of the photo-medium is the property that unlike in general coated paper, the toner receiving layer is softened and melted together with the toner by heating with the smoothing device 10. Namely, the intended function of the toner receiving layer is to be softened together with the toner by heating and pressing with the smoothing device 10 and to allow the toner to be buried therein. Therefore, as the toner receiving layer, a resin material having a glass transition temperature of within 10° C. of the glass transition temperature of the toner can be used.

Therefore, a step difference due to the toner on the surface of the recording material, which causes deterioration in glossiness, can be decreased.

Next, an example of the photo-medium used in this example is described.

The photo-medium of this example is produced by forming a transparent resin layer as the toner receiving layer on a base layer and a pigment coating layer which constitute a base material. As the base material, POD super gloss coated paper (manufactured by Oji Paper Co., Ltd.) having a pigment coating layer which has high whiteness and a smooth surface is used. The photo-medium can be produced by coating the coated paper used as base paper with a thermoplastic resin using a gravure coater.

In this example, as described above, the toner including a polyester resin containing 5 parts by weight of a wax component dispersed therein is used, and thus a polyester resin can be used as a resin which constitutes the transparent resin. This is because it is desired to soften the toner receiving layer (transparent resin layer) together with the toner by heating with the smoothing device 10. Therefore, the glass transition temperature of the toner receiving layer (transparent resin layer) is 55° C. which is substantially the same as the toner.

Although a styrene-acrylate resin, a styrene-methacrylate resin, or the like can be used as the resin which constitutes the transparent resin layer, a polyester resin is used for the above-mentioned reason.

Examples of a polyhydric alcohol component and a polyhydric carboxylic acid component which constitute the polyester resin include the following:

Examples of the polyhydric alcohol component include ethylene glycol, propylene glycol, 1,4-butanediol, 2,3-butanediol, diethylene glycol, triethylene glycol, and 1,5-pentanediol. Other usable examples include 1,6-hexanediol, neopentyl glycol, 1,4-cyclohexanedimethanol, dipropylene glycol, polyethylene glycol, polypropylene glycol, and monomers of olefin oxide-added bisphenol A.

Examples of the polyhydric carboxylic acid component include maleic acid, maleic anhydride, fumaric acid, phthalic acid, terephthalic acid, isophthalic acid, malonic acid, succinic acid, glutaric acid, and dodecylsuccinic acid. Other usable examples include n-octylsuccinic acid, n-dodecylsuccinic acid, 1,2,4-benzenetricarboxylic acid, 1,2,4-cyclohexanetricarboxylic acid, 1,2,4-naphthalenetricarboxylic acid, 1,2,5-hexatricarboxylic acid, 1,3-dicarboxy-2-methyl-2-methylenecarboxypropane, tetra(methylenecarboxy)methane, and 1,2,7,8-octanetetracarboxylic acid (trimellitic acid), pyromellitic acid, and lower-alkyl esters thereof.

The polyester resin constituting the transparent resin layer is synthesized by polymerization of at least one of the polyhydric alcohol components and at least one of the polyhydric carboxylic acid components. Since the polyester resin is used as a resin component of the toner, a thermoplastic resin having high compatibility with the toner can be selected for forming the transparent resin layer.

The transparent resin layer may further contain a pigment, a release agent, a conductive agent, and the like within a range in which the transparency is not degraded. In such a case, the amount of the resin as a main component is 80% by weight or more relative to the total weight of the resin layer. Further, the composition of the transparent resin layer is adjusted so that the surface electric resistance is $8.0\times10^{8}\Omega$ or more at a temperature of 20° C. and a relative humidity of 85%.

The production method is not limited to this, and any thermoplastic resin layer may be used as long as it has the melting property of being melted by heating with the smoothing device.

Next, the melting property of the resin which constitutes the toner receiving layer near the heating temperature of the smoothing device is described.

The melting property can be examined by measuring viscoelasticity using the measurement method (JIS K 7117-2) of measuring viscosity at a constant shear rate with a plastic-liquid, emulsive, or dispersive resin-rotary viscometer.

The resin that is melted near the heating temperature of the smoothing device has a storage modulus of $1\times10^{2}$ Pa·s to $1\times10^{6}$ Pa·s measured by the above-described method. Because when the storage modulus is lower than $1\times10^{2}$ Pa·s, the problem of worsening offset to the heating roller occurs. When the storage modulus is larger than $1\times10^{6}$ Pa·s, the toner is not sufficiently buried, thereby causing a difficulty in obtaining a good image.

The photo-medium used in this example includes a base material (base paper) having a basis weight of 150 g/m$^2$ and the toner receiving layer composed of the polyester resin and formed by coating to a thickness of 30 μm on the surface of the base material. The polyester resin further contains 1 part by weight of ester wax. Therefore, the content of the wax component in the toner receiving layer is lower than that in the toner because the polyester resin constituting the toner contains 5 parts by weight of wax component as described above. In view of compatibility with the toner, the content of the wax component in the resin which constitutes the toner receiving layer may be made zero.

(Evaluation of Fixability and Recording Material Separability)

An image was formed using the above-described image forming system to evaluate the fixability and the recording material separability of the fixing device.

Table 1 shows the results of evaluation of the fixability and the separability in the fixing device 5 in which the fixing roller was kept at a target temperature of 170° C. at varying fixing rates. First, "Separability (without toner)" described in an upper line of Table 1 is evaluated, and the "Separability (with toner)" described in a lower line is evaluated. In Table 1, a circle mark represents proper results, and a cross mark represents improper results.

TABLE 1

| | Fixing rate (mm/sec) | | | | | | | | | | | | | |
|---|---|---|---|---|---|---|---|---|---|---|---|---|---|---|
| | 200 | 190 | 180 | 170 | 160 | 150 | 140 | 130 | 120 | 110 | 100 | 90 | 80 | 70 |
| Separability (without toner) | ○ | ○ | ○ | ○ | x | x | x | x | x | x | x | x | x | x |
| Fixability | x | x | x | x | x | x | ○ | ○ | ○ | ○ | ○ | ○ | ○ | ○ |
| Separability (with toner) | ○ | ○ | ○ | ○ | ○ | ○ | ○ | ○ | ○ | ○ | x | x | x | x |

Since the photo-medium used in this example has a basis weight of 150 g/m$^2$, the fixing rate (120 mm/sec) is lower than that (200 mm/sec) of the normal paper described above. In addition, a solid image was formed with yellow toner in the image forming region of the photo-medium to evaluate the fixability of the solid image. The term "solid image" represents an image formed with no space at the maximum amount (g/cm$^2$) of the toner loaded on the photo-medium. Namely, the solid image with yellow toner is an image formed with no space at a toner loading amount determined to maximize the yellow density in reproducing yellow.

In the fixing treatment under the above-described conditions, defective separation occurs because the toner receiving layer is composed of the polyester having the same glass transition temperature as the toner and has a wax content lower than that in the toner. This is possibly due to the fact that the toner is absent from a non-image forming region, i.e., a margin, at the leasing end of the photo-medium in the conveyance direction, and thus defective separation occurs due to the toner receiving layer present in the non-image forming region.

Therefore, in order to prevent defective separation, it is desired to avoid melting of the toner receiving layer as much as possible. Therefore, it is found to be desirable to increase the fixing rate.

The evaluation results ("Separability (without toner)" in the upper line) shown in Table 1 indicate that the fixing rate at which defective separation of the photo-medium occurs is 160 mm/sec or less.

The fixability was evaluated under a condition in which heat was not stored in the fixing roller and the pressing roller immediately before turn-on of a main power supply of the apparatus. As a result, the toner was separated from the photo-medium during conveyance to cause defective fixing when the fixing rate was 150 mm/sec or more.

Therefore, there was no condition in which both the fixability and the separability were satisfied.

Accordingly, the inventors thought that defective separation can be suppressed by forming, in the margin portion of the photo-medium, a predetermined image pattern using a toner containing a wax component in a larger amount than in the toner receiving layer.

Figure 1:
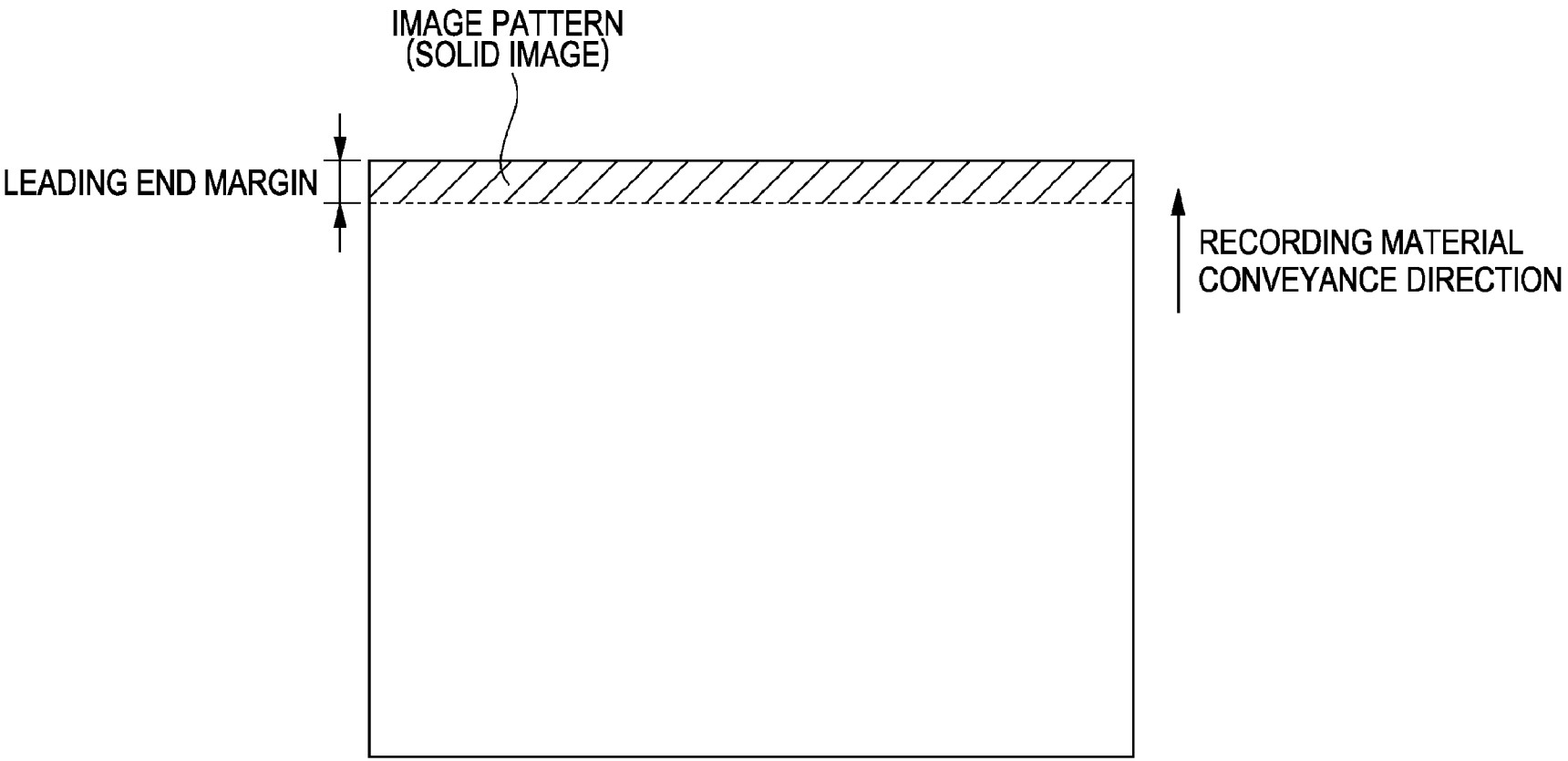
FIG. 1 is a schematic drawing showing a photo-medium on which a toner image is formed in a non-image portion of a leading end margin.

In this example, the margin region at the leading end of the photo-medium in the conveyance direction is 10 mm from the leading end. As shown in FIG. 1, a toner image (solid image) was formed over the entire region of the margin using yellow toner to conduct the same evaluation as described above ("Separability (with toner)" in Table 1). In other words, the solid image was formed over the entire region of the margin portion in the width direction (perpendicular to the conveyance direction). Although, in this example, the non-image forming region referred to as the "margin" is provided over the entire periphery of the recording material, a predetermined image pattern (solid image) was formed in a margin at the leading end of the recording material in the conveyance direction. Namely, in this example, the image forming region is provided inside the margin region provided over the entire periphery of the recording material so that a usual image is formed in the image forming region on the basis of image data input from the copy document reading device or an external host computer.

Table 1 shows that defective fixing occurs at a fixing rate of 150 mm/sec or more, and defective separation occurs at a fixing rage of 100 mm/sec or less.

The toner used in this example is composed of the polyester resin having substantially the same glass transition temperature as the toner receiving layer, but the wax content is higher than that in the toner receiving layer. Therefore, it is thought that even when the toner is sufficiently melted, an increase in adhesive force to the fixing roller is suppressed by a large amount of wax, thereby improving the separability.

Therefore, as in this example, when a toner image is formed over the margin at the leading end of the photo-medium in the conveyance direction, a condition in which both the fixability and the separability are satisfied can be attained at a fixing rate of 110 mm/sec to 140 mm/sec.

Although, in this example, the toner image was formed over the entire region (the region shown by an arrow in FIG. 1) of the margin portion of 10 mm in width of the photo-medium, the width (in the conveyance direction of the recording material) of the margin in which the toner image is formed is not limited to this value. As the width (in the conveyance direction of the recording material) of the margin in which the toner image is formed increases, the separability improves, but the toner consumption is increased. As the width decreases, the sufficient effect cannot be obtained. In view of this relationship, in order to achieve a satisfactory effect on the separability, the desired width (in the conveyance direction of the recording material) of the margin in which the toner image is formed is 5 mm or more, depending on the content of the wax component in the toner.

The solid image may be formed using a toner of one color, and the toner (color) used is not necessarily fixed. Therefore, the toner (color) used may be changed at each time images are formed on a predetermined number of photo-media (for example, one or ten photo-media). This can prevent the over-consumption of a toner of a color relative to other toners. In addition, a toner which remains in the largest amount in the margin portion when an image is formed on the photo-medium can be used. When the above-described four color toners having different wax component contents are used, a toner having a high wax component content can be used for forming a predetermined image pattern. Namely, when first and second color toners having different wax component contents are used, a toner having a higher wax component content among the first and second toners can be used for forming a predetermined image pattern.

Although, in this example, a solid image is formed as a predetermined image pattern in the margin portion, the image pattern is not limited to this. For example, toner images may be formed as dot images at a predetermined interval or a solid image may be formed on only a portion of the margin in the width direction (perpendicular to the conveyance of the recording material and along the axis of rotation of the fixing roller). In other words, the predetermined image pattern formed on the margin portion is not limited to the above-described examples as long as it is easy separable and satisfies the separability of the photo-medium.

(Image Formation Sequence According to Type of Recording Material)

Next, the image formation sequence according to the type of the recording material used is described. The sequence is controlled by the control device W as an image pattern forming device.

(1) Manual Setting

Figure 8:
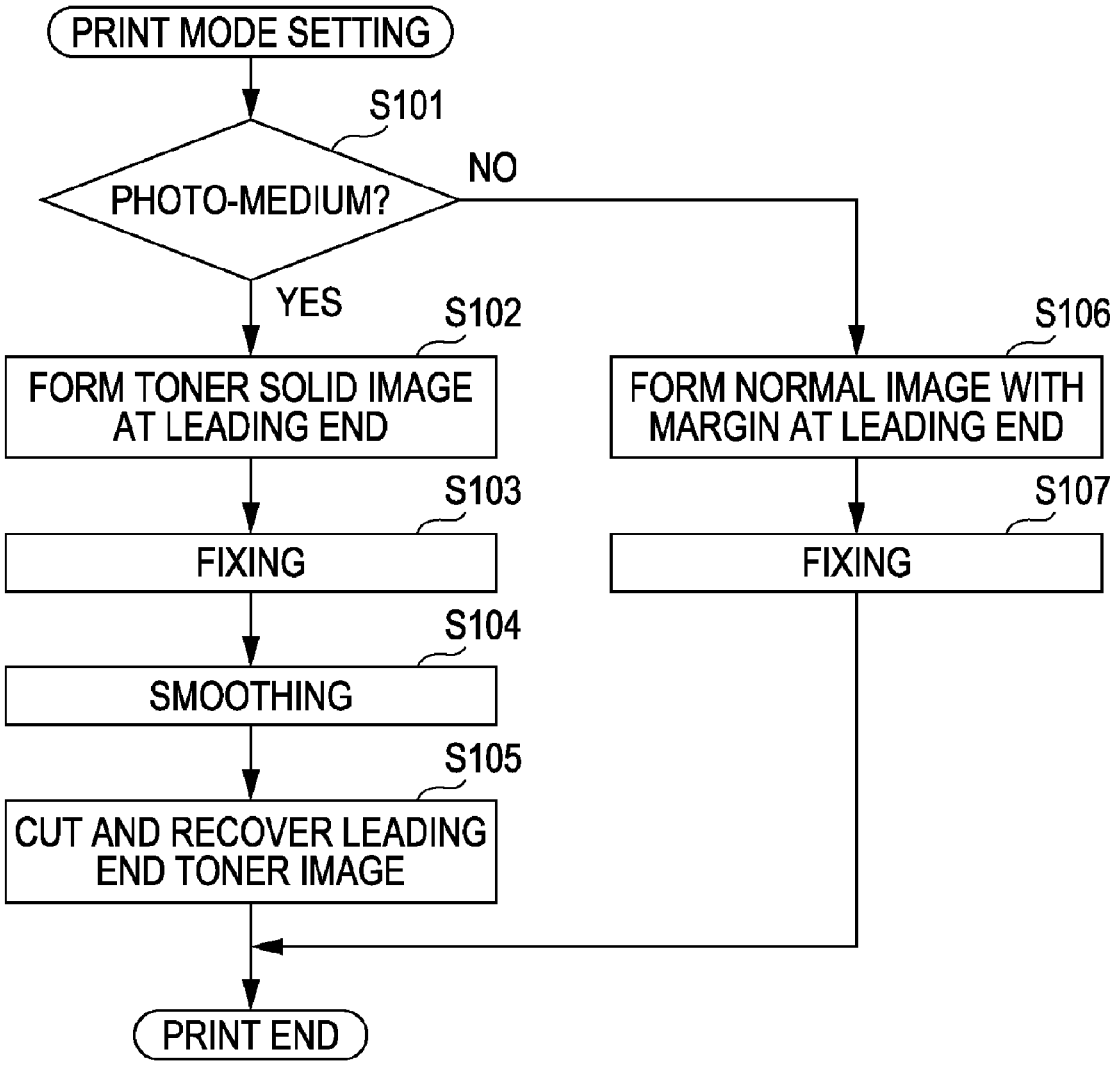
FIG. 8 is a flowchart (manual setting) of image formation in Example 1.

An example of manual setting of the type of the recording material is described on the basis of a flowchart of FIG. 8. Namely, the type of the recording material is set by a user through a liquid crystal display Z installed as an operating unit in an upper portion of the image forming device. When the type of the recording material is set on the liquid crystal display, the control device W which receives information decides whether or not the recording material is the photo-medium.

When the type of the recording material is not the photo-medium (S101, No), normal image formation is performed according to a document without the formation of an image on the margin portion at the leading end of the recording material in the conveyance direction (S106). The toner image formed on the recording material is fixed by the fixing device 5 (S107) and then ejected to the outside (the ejection tray 123) without being conveyed to the smoothing device 10. In this case, a flapper 122 shown in FIG. 5 is switched to convey the recording material in direction A shown in FIG. 5.

On the other hand, when the type of the recording material is the photo-medium (S101, Yes), a toner solid image is formed in the margin at the leading end of the photo-medium as described above (S102). Then, the toner image is fixed to the photo-medium by the fixing device 5 (S103) and the photo-medium is then conveyed to the smoothing device 10. In this case, the flapper 122 shown in FIG. 5 is switched to convey the recording material in direction B shown in FIG. 5. The photo-medium subjected to temporary fixing is smoothed by the smoothing device 10 (S104) and then conveyed to the cutting device 116. In the cutting device 116, the photo-medium is cut so that the solid image formed in the margin at the leading end is separated from a normal image (S105) and then ejected to the outside (ejection tray 121). In the cutting device 116, all the other margin portions in the periphery of the photo-medium are cut off to form a marginless image like a silver-halide photograph. The unnecessary portions produced by cutting are recovered to the recovery device 120.

(2) Automatic Setting

Figure 9:
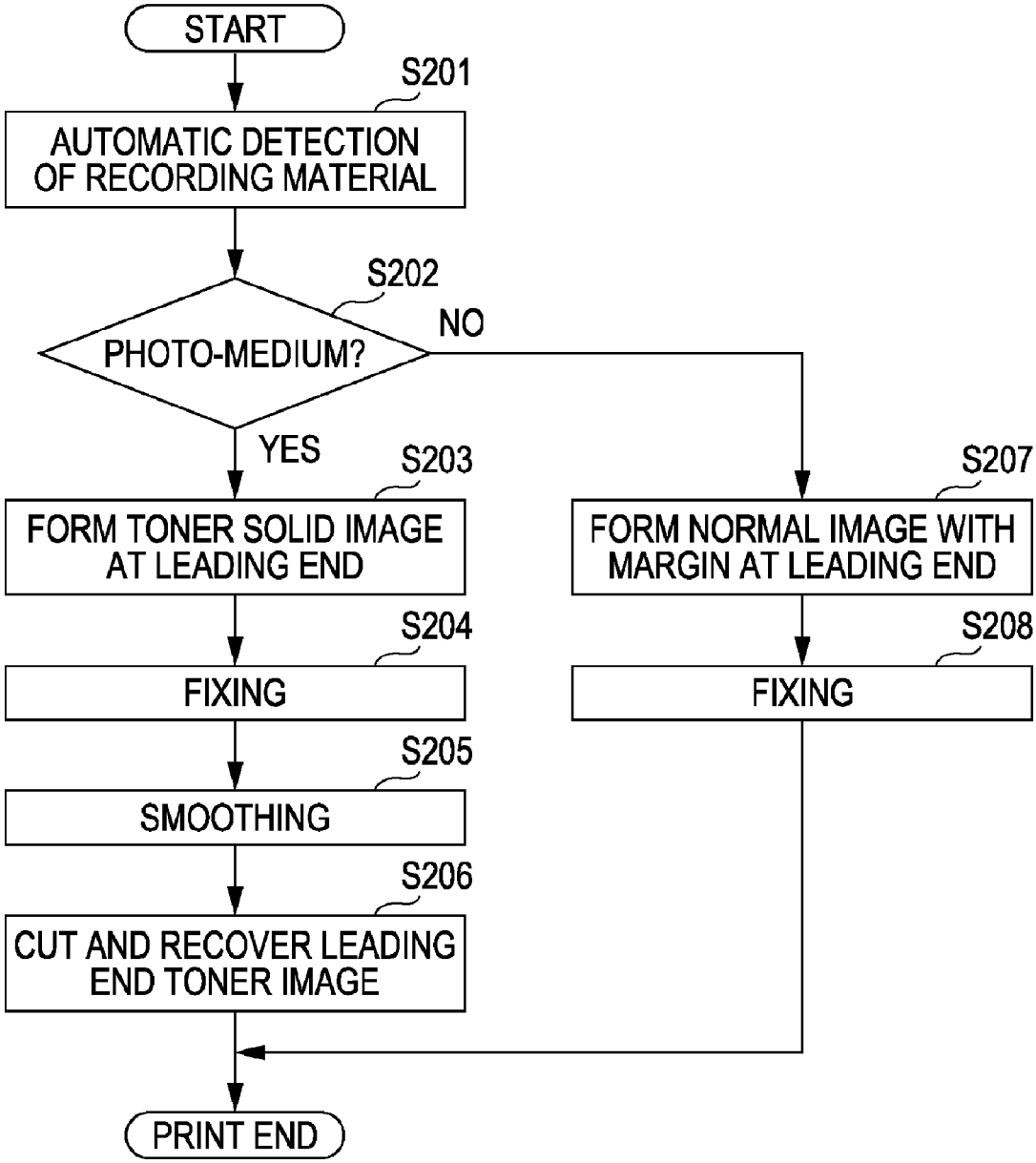
FIG. 9 is a flowchart (automatic setting) of image formation in Example 1.

Next, an example of automatic setting of the type of the recording material is described on the basis of a flowchart of FIG. 9.

Figure 10:
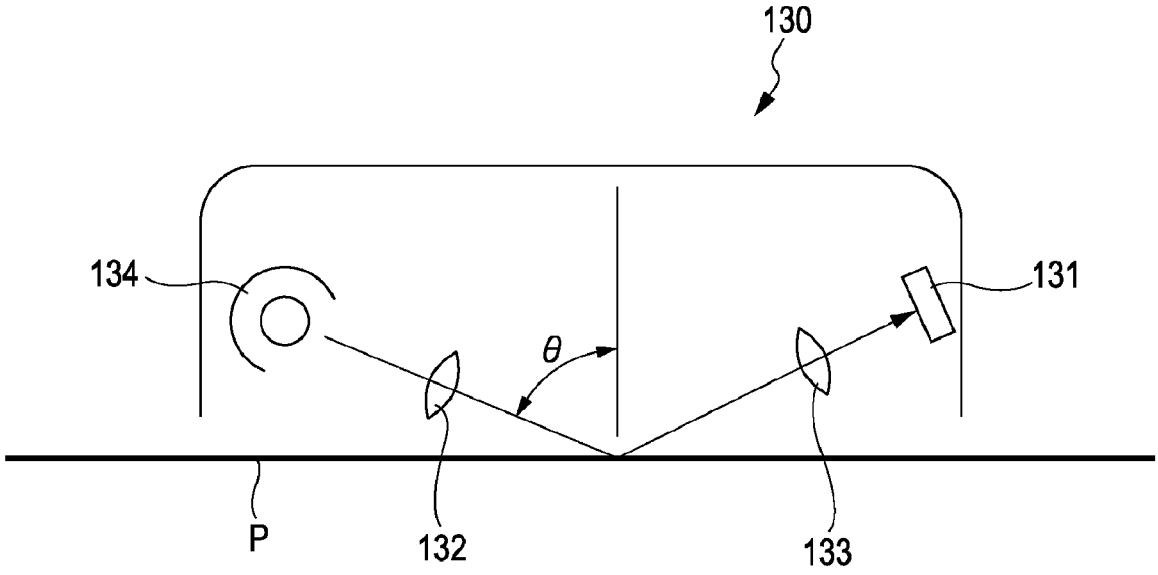
FIG. 10 is a schematic drawing showing a detector for discriminating a photo-medium.

In this example, a detector 130 disposed near the cassette 61, for detecting the type of the recording material, as shown in FIG. 10 is used.

The detector 130 is configured to detect the surface glossiness of the recording material by the method defined in JIS Z 8741 and decide whether or not the recording material is the photo-medium (S201). Specifically, in the detector 130, a light flux emitted from a light source 134 is incident on the photo-medium at angle θ through a lens 132. The light flux reflected in a specular reflection direction is detected by an optical receiver 131 through a lens 133.

When it is decided by the detector 130 that the type of the recording material is not the photo-medium (S202, No), as described above, normal image formation is performed according to a document without the formation of an image on the margin portion at the leading end of the recording material in the conveyance direction (S207). The toner image formed on the recording material is fixed by the fixing device 5 (S208) and then ejected to the outside.

On the other hand, when it is decided by the detector 130 that the type of the recording material is the photo-medium (S201, Yes), a toner solid image is formed in the margin at the leading end of the photo-medium as described above (S203). Then, the toner image is fixed to the photo-medium by the fixing device 5 (S204) and the photo-medium is then smoothed by the smoothing device 10 (S205). Then, the photo-medium is cut by the cutting device 116 (S206) and ejected to the outside.

In this way, image formation conditions are changed according to whether or not the type of the recording material is the photo-medium so that the separability of the photo-medium can be improved without uselessly forming an image in the margin of the recording material such as normal paper.

Although, in this example, the predetermined image pattern is formed in the margin of the photo-medium, the output quality is not degraded because the margin portion is cut by the cutting device.

EXAMPLE 2

Next, Example 2 is described. In Example 1, a predetermined image pattern is formed in the margin at the leading end of the photo-medium using color toners of yellow, magenta, cyan, and black. However, in this example, a transparent toner is used. Since the other configuration is the same as in Example 1, a description thereof is omitted.

The transparent toner does not contain a colorant, and a resin material which constitutes the toner is the same as in the color toners. Namely, the transparent toner contains a polyester resin containing 5 parts by weight of a wax component dispersed therein. The glass transition temperature of the transparent toner is also 55° C. The transparent toner used in this example is white in an unfixed state, but toner particle lumps are integrated by melting and become colorless and transparent after fixing.

In this example, the separability of the photo-medium and fixability in the fixing device were evaluated to obtain the same results as in Table 1 ("Separability (with toner)" in the lower line).

In other words, even when a predetermined image pattern is formed using the transparent toner in the margin at the leading end of the photo-medium, the fixability and the separability can be satisfied as in Example 1.

Figure 11:
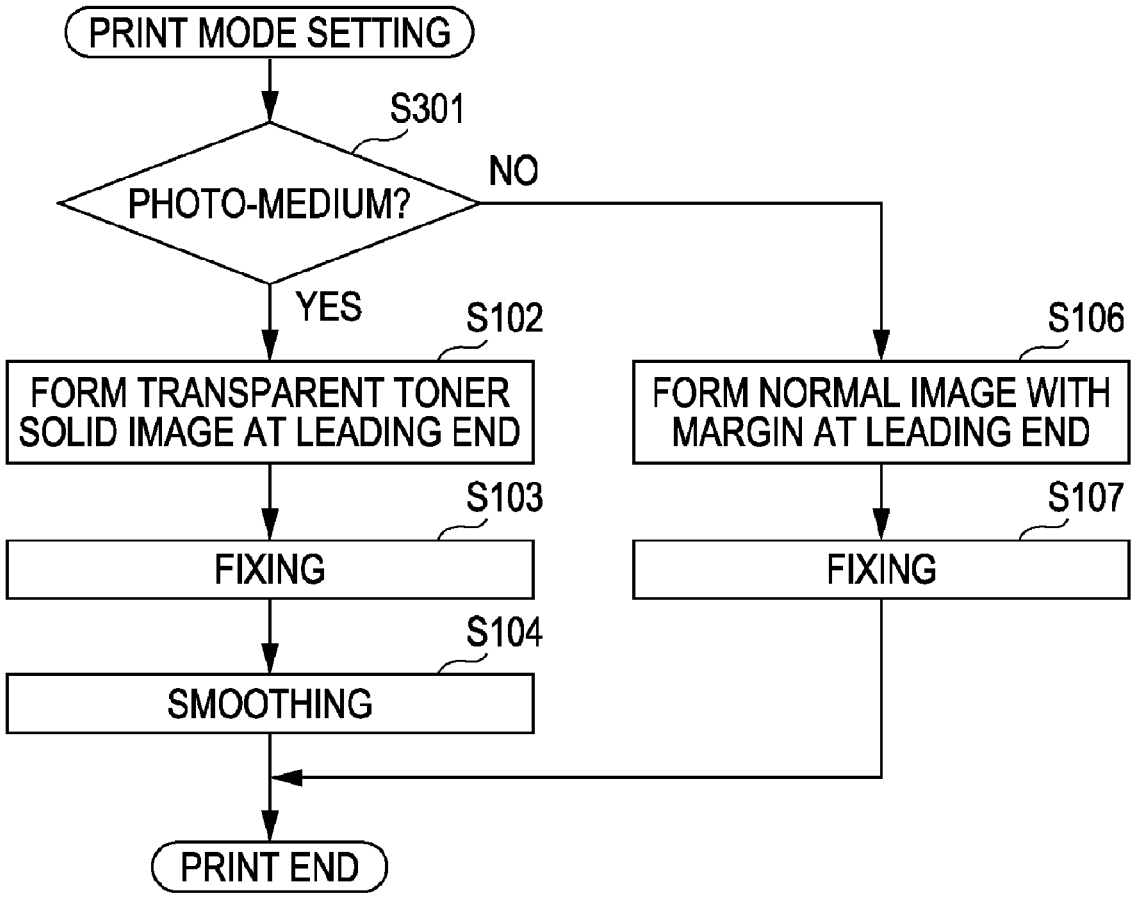
FIG. 11 is a flowchart (manual setting) of image formation in Example 2.
Figure 12:
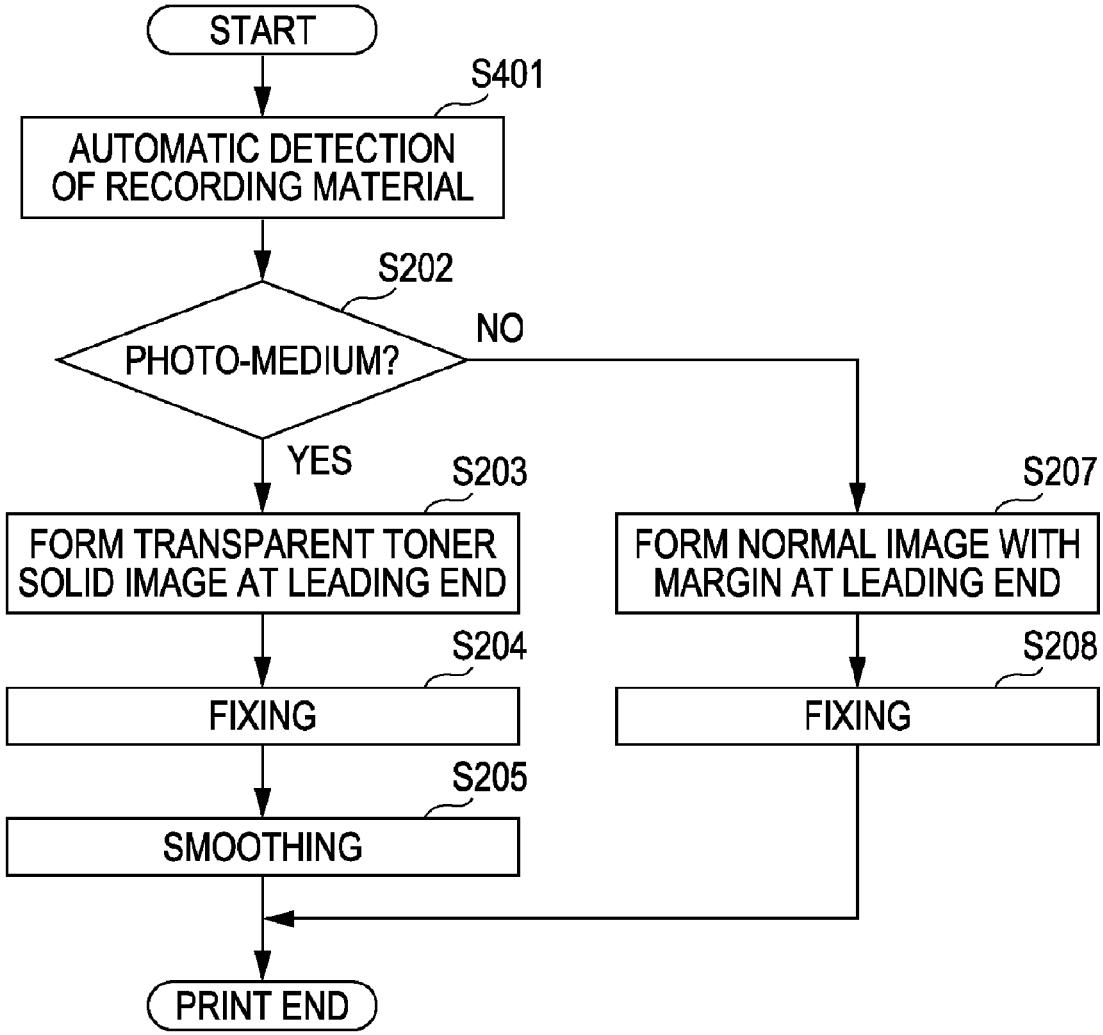
FIG. 12 is a flowchart (automatic setting) of image formation in Example 2.

The image formation sequence according to the type of the recording material is performed according to the flowcharts of FIGS. 11 and 12.

FIG. 11 shows an example of manual setting of the type of the recording material, and FIG. 12 shows an example of automatic setting of the type of the recording material. Both figures are the same as FIGS. 8 and 9, respectively, except that the transparent toner is used for forming the image in the margin at the leading end of the photo-medium (S301, S401) and the step of cutting the photo-medium with the cutting device is omitted. Therefore, a further description is omitted. In FIGS. 11, 12, the steps with the same contents as in FIGS. 8 and 9 are denoted by the same numbers.

In this example, the reason for omitting the step of cutting the photo-medium by the cutting device is that the use of the transparent toner can make the predetermined image pattern less noticeable in an output. Therefore, in this example, the cutting device can be omitted to miniaturize the apparatus.

As in Example 1, the portion in which the image has been formed by the transparent toner may be cut off with the cutting device.

Therefore, in this example, the photo-medium can be appropriately smoothed, and thereby a sufficiently smoothed output can be obtained.

EXAMPLE 3

Next, Example 3 is described. In this example, as in Example 2, a predetermined image pattern is formed using a transparent toner in a margin at the leading end of a photo-medium, but the composition of the transparent toner is different in Example 2. The other configuration is the same as in Examples 1 and 2, and thus a description thereof is omitted.

Specifically, the resin component of the transparent toner used in this example has a wax component content different from that of the other color toners. Namely, the wax component content in the transparent toner is higher than that of the other color toners.

This is because although the conditions of the materials used for the color toners are limited in view of reproducibility and glossiness when a full-color image is formed, the transparent toner does not have such a limitation. In other words, the separability of the photo-medium in the fixing device is further improved by changing the material composition of the transparent toner which little influences image reproducibility.

Although a color toner contains 5 parts by weight of a wax component relative to the weight of the toner resin component, the transparent toner contains 10 parts by weight of a wax component relative to the weight of a toner resin component.

The results of evaluation using the transparent toner are shown in Table 2. The evaluation conditions are the same as in Example 1. In Table 2, the results of fixability are shown in an upper line, and the results of separability are shown in a lower line. Table 2, a circle mark represents proper results, and a cross mark represents improper results.

TABLE 2

| | Fixing rate (mm/sec) | | | | | | | | | | | | | |
|---|---|---|---|---|---|---|---|---|---|---|---|---|---|---|
| | 200 | 190 | 180 | 170 | 160 | 150 | 140 | 130 | 120 | 110 | 100 | 90 | 80 | 70 |
| Fixability | x | x | x | x | x | x | ○ | ○ | ○ | ○ | ○ | ○ | ○ | ○ |
| Separability (with toner) | ○ | ○ | ○ | ○ | ○ | ○ | ○ | ○ | ○ | ○ | ○ | ○ | x | x |

The results shown in Table 2 indicate that the fixability is the same as in Examples 1 and 2, but the separability in the fixing device is degraded at a fixing rate of 80 mm/sec or less.

Namely, when the transparent toner having a higher wax component content than that in Examples 1 and 2 is used for forming the predetermined image pattern in the margin at the leading end of the photo-medium in the conveyance direction, the range of occurrence of defective separation is narrower than that in Examples 1 and 2.

Therefore, the fixing rate of the photo-medium can be determined within a wide range, and the separability of the photo-medium can be further increased at the fixing rate (120 mm/sec) of the photo-medium.

As a result, the configuration of this example can sufficiently prevent the occurrence of defective separation in the fixing device, and as in Examples 1 and 2, the photo-medium can be properly smoothed. Therefore, in this example, a sufficiently smoothed output can be obtained.

Although, in Examples 1 to 3, a belt fixing device including a roller on the heating side and a belt on the pressing side is described as an example of the fixing device, the fixing device is not limited to this. For example, the present invention can also be applied to a fixing device including a heating roller and a pressing roller, a fixing device including heating belt and a pressing roller, and a fixing device including a heating belt and a pressing belt.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-160216 filed Jun. 18, 2007, which is hereby incorporated by reference herein in its entirety.

What is claimed is:

1. An image forming system comprising:

an image forming unit for forming an image using a toner containing a wax component on a recording material having a surface provided with a toner receiving layer which is composed of a thermoplastic resin;

a fixing unit for heat-fixing the image formed on the recording material by the image forming unit in a nip portion and separating the recording material kept at a high temperature;

a smoothing unit for smoothing the surface of the recording material by heating, cooling, and then separating the recording material on which the image has been fixed by the fixing unit; and an image pattern forming unit for forming a predetermined image pattern in a non-image forming region at the leading end of the recording material in the conveyance direction.

2. The image forming system according to claim 1, wherein the image pattern forming unit forms the predetermined image pattern using a transparent toner.

3. The image forming system according to claim 1, wherein the image forming unit is configured to form an image using a plurality of toners of different colors, and the toner used for forming the predetermined image pattern in the image pattern forming unit can be changed.

4. The image forming system according to claim 1, further comprising:

a cutting unit for cutting the non-image forming region at the leading end of the recording material in the conveyance direction after smoothing by the smoothing unit.

5. The image forming system according to claim 1, wherein the image pattern forming unit forms a toner image over the entire region of the non-image forming region in the width direction thereof at the leading end of the recording material in the conveyance direction.

6. The image forming system according to claim 1, wherein the content of the wax component in the toner receiving layer is zero or the content of the wax component in the toner receiving layer is lower than that in the toner.

* * * * *